US005524858A

United States Patent [19]

Friend

[11] Patent Number: 5,524,858

[45] Date of Patent: Jun. 11, 1996

[54] SUPPORT ARRANGEMENT

[76] Inventor: Thomas A. Friend, 8002 River Rd., Grand Rapids, Minn. 55744

[21] Appl. No.: 490,066

[22] Filed: Jun. 13, 1995

[51] Int. Cl.[6] ..... F16M 13/00

[52] U.S. Cl. ..... 248/548; 232/39; 248/900

[58] Field of Search ..... 248/548, 900, 248/145, 417; 403/67; 52/98; 232/39

[56] References Cited

U.S. PATENT DOCUMENTS

| | | | |
|---|---|---|---|
| 2,605,073 | 7/1952 | Buck | 248/145 |
| 3,899,150 | 8/1975 | Racquet | 248/145 |
| 4,852,847 | 8/1989 | Pagel | 248/548 |
| 4,858,876 | 8/1989 | Moreno | 248/900 X |
| 4,955,533 | 9/1990 | Merkel | 248/145 X |
| 4,995,576 | 2/1991 | Kieswetter | 403/67 X |
| 5,020,720 | 6/1991 | Harpe | 248/145 X |
| 5,160,111 | 11/1992 | Hugron | 52/98 X |
| 5,214,886 | 6/1993 | Hugron | 52/98 |
| 5,215,283 | 6/1993 | Gould | 232/39 X |
| 5,437,409 | 8/1995 | Coushaine | 248/900 X |

*Primary Examiner*—J. Franklin Foss
*Attorney, Agent, or Firm*—Jerold M. Forsberg

[57] ABSTRACT

A support arrangement for supporting an object above ground level is designed to reduce hazards for passing motorists. The support arrangement includes an above-ground portion rigidly connected to an in-ground portion by a frangible connector assembly. The above-ground portion can include a generally horizontally extending portion for supporting an object in a cantilevered manner. The horizontally extending portion is formed as part of a moveable portion connected to a generally vertically extending fixed portion by a rotatable connector assembly. The support arrangement is designed to bend and break away in a predetermined manner when impacted and, if it does not break, the rotatable connector is designed to permit the moveable portion to be pulled free and thrown clear of the vehicle. If only the cantilevered object is impacted, the object and moveable portion can rotate out of the path of the impacting force. Once the impacting force has passed, the moveable portion will return to an at-rest position.

30 Claims, 5 Drawing Sheets

10
12M
20
22
24
26
28
30
32
34
36
38
40
42
62
98
100
102
104
a
b
c

SUPPORT ARRANGEMENT

BACKGROUND OF THE INVENTION

The present invention relates generally to a support arrangement for supporting an object above ground level and more particularly to a support arrangement which reduces hazards for motorists when used to support objects along a roadside, e.g., mailboxes, signs, markers, etc. The support arrangement includes an above-ground portion rigidly connected to an in-ground portion by a frangible connector assembly. In applications where the above-ground portion includes a generally horizontally extending portion for supporting an object in a cantilevered manner, the horizontally extending portion is formed as part of a moveable portion connected to a generally vertically extending fixed portion by a rotatable connector assembly.

There are problems with positioning any structure close to an edge of a roadway. Suburban and rural areas most often have mail delivered to roadside mailboxes which are supported such that the vehicle from which the mail is delivered can simply stop in front of the mailbox where the driver can reach out, open the mailbox and deliver the mail. Signs for advertising including signs for real estate are typically positioned close to the edge of a roadway to attract the attention of passersby. One problem created by mailboxes and signs is the lack of sufficient clearance for graders to reshape and grade the roads and for snowplows to clear the roadways of snow and ice. A more significant problem is the injury that may occur to passengers and damage to vehicles which hit an object and/or the support for the object when the vehicles deviate from the roadway e.g., when they leave the roadway to avoid hitting children, animals, other vehicles, etc. An important problem for property owners is the damage to a roadside support and object which may result due to the exposure to plows, vehicles, vandals, etc.

Owners of mailboxes and signs along a roadside typically are less concerned about the hazard their mailbox and/or sign and the support therefor creates for others and since it is not uncommon for a plow or an errant vehicle to hit a roadside mailbox or sign, owners frequently erect supports which are extremely strong and, accordingly, extremely hazardous. The approach taken by many 14 mailbox and/or sign owners is to space the main vertical support away from the edge of the roadway and include an arm extending horizontally toward the roadway with the mailbox or sign mounted thereon. This approach permits a plow to clear a roadway all the 18 way to the edge and yet have a mailbox positioned where the driver of a mail delivery vehicle can reach out and deliver mail to the mailbox and a sign positioned where it is clearly visible to passersby. In these arrangements the vertical support is frequently constructed in a manner providing inordinate strength and the horizontally extending portion can present hazards to the passengers of the vehicle by penetrating the windshield or side windows of the vehicle in an accident. The problem of penetrating the side windows is a result of constructing the support arrangement such that the horizontally extending arm can rotate 360 degrees around the fixed portion of the support.

To date there are no universal standards for support arrangements along rural and suburban roadways. Reports verify that mailboxes and their supports are frequently constructed in a manner which are hazardous upon impact to a vehicle and its passengers and it was noted during the development of the instant invention that many roadside signs present hazards to vehicles and their passengers similar to those created by most mailboxes and their supports. Even though federal standards were set years ago for light posts and sign posts along interstate highways, there are still no federal standards for supports for mailboxes along roadways in urban and rural areas. Each state has authority to mandate support requirements for signs along state highways but in many areas there are no regulations or standards. There is a Task Force for Roadside Safety of the Standing Committee on Highways Subcommittee on Design which has been working on standards for erecting mailboxes on highways and a guide has been published by the American Association of State Highway and Transportation Officials which outlines many of the problems and hazards of existing roadside mailbox supports. Until the instant invention there was no single answer to the question of reducing roadside hazards.

Prior inventions have attempted to reduce hazards created by roadside mailboxes for passengers and vehicles using a roadway. An example of a repositionable support is depicted in U.S. Pat. No. 4,915,293. There have also been various approaches to providing a mailbox support which will permit the mailbox to swing out of the way if struck by a plow. Examples of such supports are found in the following U.S. Pat. Nos. 3,870,262; 3,881,650; 4,113,213; 4,130,239; and 4,955,533. An example of a support which permits a sign to swing out of the way and return to its original position is depicted in U.S. Pat. No. 3,229,940. Examples of support arrangements designed to absorb energy and/or break away are depicted in U.S. Pat. No. : 4,286,747; 4,759,161; and 4,852,847. These prior art patents along with others found during a novelty search will be listed on a PTO Form 1449 which will be forwarded in accordance with the duty disclose.

Accordingly, it is of major concern that millions of mailboxes and signs along rural roads and suburban streets and highways throughout the United States present roadside hazards to motorists. The effort currently underway by the above noted Task Force is to minimize injuries to occupants of motor vehicles which impact roadside mailboxes by establishing standards for mailbox supports. The instant invention is believed to answer the need and set the standards.

There is a market, then, for support arrangements, and particularly for support arrangements which are effective for mailboxes, which are capable of permitting the mailbox to swing out of the way of a vehicle impacting thereon, and which will bend and break when struck by a vehicle such that passengers in the vehicle are not imperiled, especially if such a device is simple in construction and easy to use.

SUMMARY OF THE INVENTION

It is a primary purpose and principle object of the present invention to provide a support arrangement for an object supported above ground level which is safe, effective, simple to use, economical to manufacture and which will rotate away or bend and break away in a manner such that the object and the support arrangement will not come through the windshield or side windows of the vehicle and thereby cause injury to the occupants.

The present invention, broadly stated, involves a support arrangement which has a frangible connector between an in-ground portion and an above-ground portion. The above-ground portion can support any type of object, e.g., mailboxes, birdhouses, road signs, real estate signs, etc., and can include a moveable portion connected to a fixed portion by a rotatable connector assembly when a horizontally extending portion is used as a cantilevered support for the object. The rotatable connector assembly permits the object to swing out of the way when impacted, e.g., out of the way if struck by a vehicle or out of the path of snow thrown by a plow. The frangible connector assembly permits the support arrangement to bend and break in controlled manner such that the object is accelerated out of the path of the vehicle.

Accordingly, it is also an object of this invention to provide a support arrangement which includes an above-ground portion rigidly attached to an in-ground portion by a frangible connector assembly.

It is a further object of this invention to provide a frangible connector assembly which will concentrate stresses created by an impact on an above-ground portion on an in-ground portion and cause bending and breaking in the area of stress concentration.

An additional object of the invention is to provide a support arrangement with an above-ground portion which includes a moveable portion attached to a fixed portion by a rotatable connector assembly.

Another object of this invention is to provide a rotatable connector assembly between a movable portion and a fixed portion which controls and limits movement of the movable portion.

Yet another object of the invention is to provide an extension for said in-ground portion which utilizes a portion of the same cross-sectional dimensions as the in-ground portion and which creates another frangible connector assembly with stress concentrations on said in-ground portion.

A further object of this invention is to provide for stable attachment of a mailbox to a horizontally disposed portion and to provide for the attachment of additional objects such as newspaper tubes and signs.

These and other objects and advantages of the present invention will be apparent and understood from the following detailed description when taken in conjunction with the accompanying drawings.

DETAILED DESCRIPTION OF THE INVENTION

Figure 1:
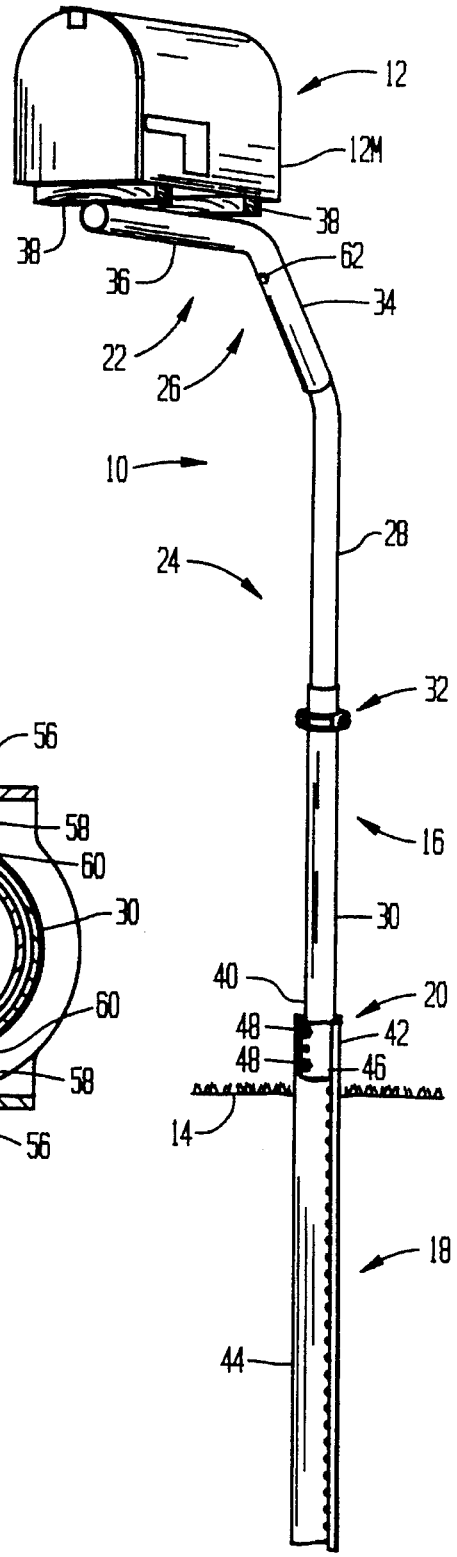
FIG. 1 is a perspective view of a support arrangement according to the present invention supporting a mailbox.

A support arrangement 10 supporting an object 12 at a predetermined height above ground level 14, constructed in accordance with the principles of this invention, is described hereinbelow, with reference to the accompanying drawings, wherein like reference numerals are used throughout the various views to designate the same or similar elements or components.

Figure 2:
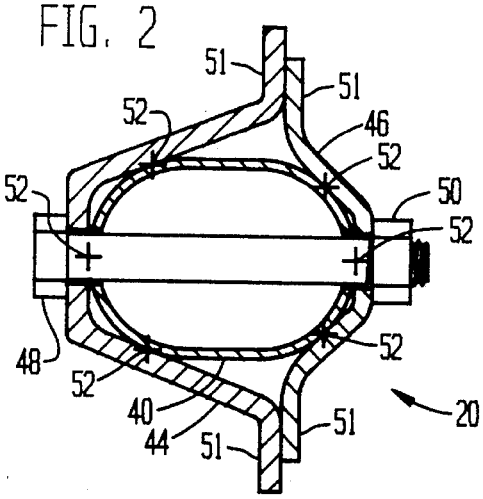
FIG. 2 is a cross-section view of the support arrangement depicted in FIG. 1 taken along line II—II in FIG. 12.

Referring now to FIG. 1, support arrangement 10, depicted supporting a mailbox 12M, includes an above-ground portion 16 connected to an in-ground portion 18 by a frangible connector assembly 20. The above-ground portion 16 includes a moveable portion 22 connected to a fixed portion 24 by a rotatable connector assembly 26. The fixed portion 24 includes a middle pipe 28 connected to a base pipe 30 by a yoke clamp assembly 32 and moveable portion 22 includes a top pipe 34 which in turn includes a horizontally extending portion 36. Wood blocks 38 are attached transversely to the horizontally extending portion 36 and mailbox 12M is attached to wood blocks 38 by threaded fasteners (not shown). As best seen in FIG. 2, lower end 40 of base pipe 30 is generally elliptical in cross-section, for reasons which will be discussed in detail later. In-ground portion 18 includes a ground post 44 with an exposed end 42. Lower end 40 of base pipe 30 is laterally encapsulated by exposed end 42 and cap post 46. Cap post 46 secures base pipe 30 to ground post 44 with at least two bolts 48 cooperating with nuts 50.

The frangible connector assembly 20, shown in greater detail in FIG. 2, depicts the manner in which the ground post 44 and cap post 46 laterally encapsulate elliptical lower end 40 of the base pipe 30 and how the elliptical lower end 40 is secured relative to the ground post 44 by bolts 48 extending through aligned apertures in the components and drawn tight by nuts 50. As the nuts 50 are tightened, the laterally extending flanges 51 of the cap post and ground post abut one another and cause a slight deformation of the truncated V-shaped cross-sections of the ground post and cap post until six lines of contact 52 exist between the elliptical lower end 40, the ground post 44, and the cap post 46. The six lines of contact appear as points 52 in this cross sectional view, and position of each point is indicated by a +. The lines of contact 52; are generally parallel to the longitudinal axis of ground post 44 and extend the length of the cap post 46. The fact that there are six lines of contact provides greater stability for the above-ground portion and the manner in which this rigid connection is frangible will be discussed later.

Figure 3:
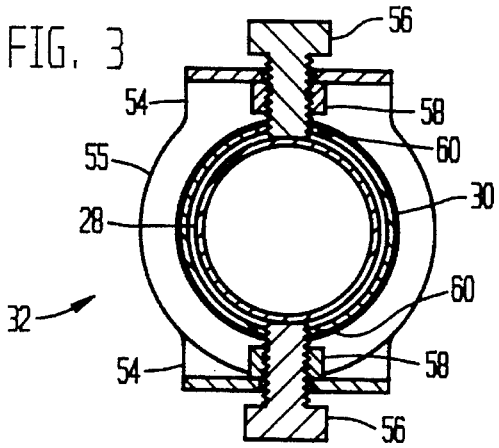
FIG. 3 is a cross-section view of the support arrangement depicted in FIG. 1 taken along line III—III in FIG. 12.

The clamping assembly 32, shown in greater detail in FIG. 3, has middle pipe 28 telescopically received within base pipe 30 and secured relative thereto by a pair of yoke clamps 54. Each yoke clamp 54 includes a fixed loop 55, which extends loosely around base pipe 30, a bolt 56, and a nut 58 fixed relative to the fixed loop such that the bolt 56 is radially adjustable. Base pipe 30 includes a pair of diametrically opposed apertures 60 near its upper end which permit bolts 56 to pass therethrough where they can engage and secure middle pipe 28 relative to base pipe 30. This arrangement permits adjustment of the height of the horizontally extending portion 36 above ground level and yet will yield to extreme forces by permitting middle pipe 28 to be withdrawn from base pipe 30 when the forces exerted by bolts 56 of the yoke clamps 54 are overcome.

Figure 4:
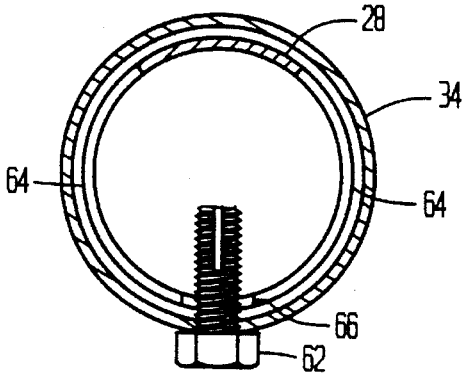
FIG. 4 is a cross-section view of the support arrangement depicted in FIG. 1 taken along line IV—IV in FIG. 12.

The relationship of the components of the rotatable connector assembly 26 are best seen in FIG. 4. Top pipe 34 is telescoped over the upper end of middle pipe 28 and secured relative thereto by a bolt 62 extending into a slot 64 in middle pipe 28. Slot 64 extends transversely of the middle pipe 28 and is disposed proximate to the end thereof. Bolt 62 is preferably self-tapping and threaded relative to top pipe 34 with sufficient length and is sized to extend into the slot 64 so as to slide and be guided thereby. Slot 64 includes a notch 66 centrally disposed along the length thereof for cooperating with bolt 62 to create a centered at-rest position for the horizontally extending portion 36. It has been found that slot 64 can extend more than 270 degrees around the middle pipe 28 and in practice actually extends 281 degrees. Any weakness created in the upper end of middle pipe 28 is compensated for by the strength of top pipe 34 telescoping thereover.

Figure 5:
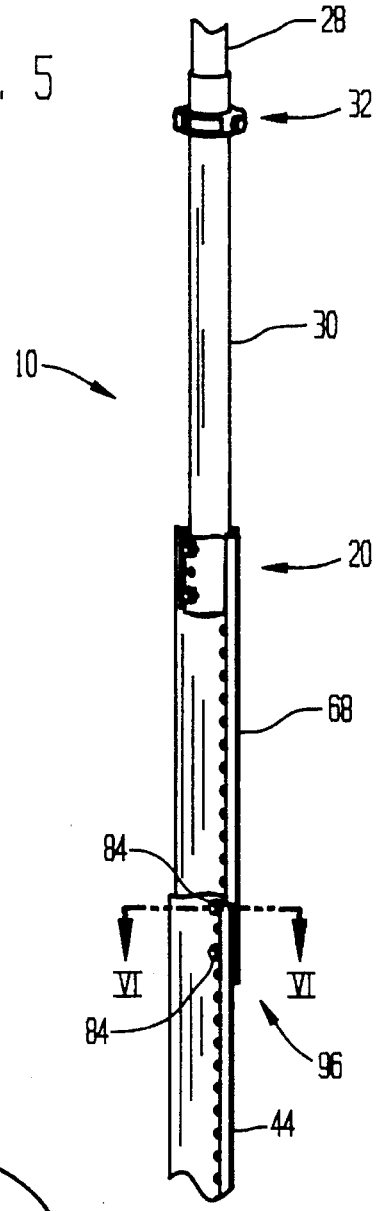
FIG. 5 is a partial view showing an extension used with the support arrangement depicted in FIG. 1.
Figure 6:
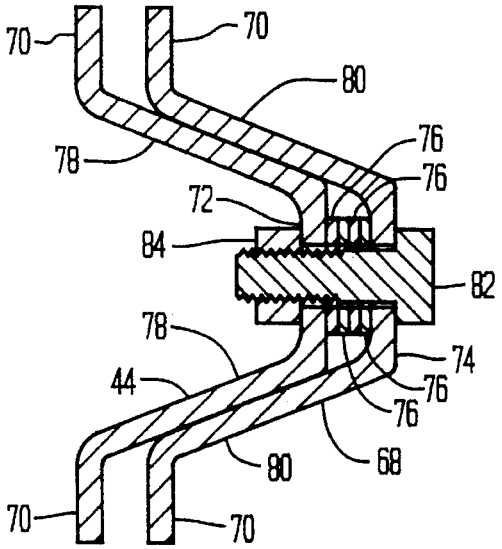
FIG. 6 is a cross-section view of the support arrangement depicted in FIG. 5 taken along line VI—VI in FIG. 5.

In situations where the ground post 44 needs extra length, extension 68, best seen in FIGS. 5 and 6, which can have the same truncated V-shaped cross-sectional dimension as the ground post 44, is secured to ground post 44 and forms another frangible connection therewith. The need for an extension occurs when there is a steep bank along the edge of the roadway and when included provides additional safety by including a second frangible connection. The frangible connection between the ground post and extension is accomplished by nesting the ground post 44 within the extension 68, or vice versa, and including spacers 76 to fill the void between the bight 72 of the truncated V of ground post 44 and the bight 74 of the truncated V of extension 68 and extending a pair of bolts 82 through aligned apertures in the components and securing the bolts with nuts 84. When the ground post and extension are nested, the sides 78 of the truncated V of the ground post 44 contact the sides 80 of the truncated V of the extension 68 thereby cooperating with the bolts 82 to create a rigid connection which is frangible in the same manner as the frangible connector 20, which will be discussed later.

Figure 7:
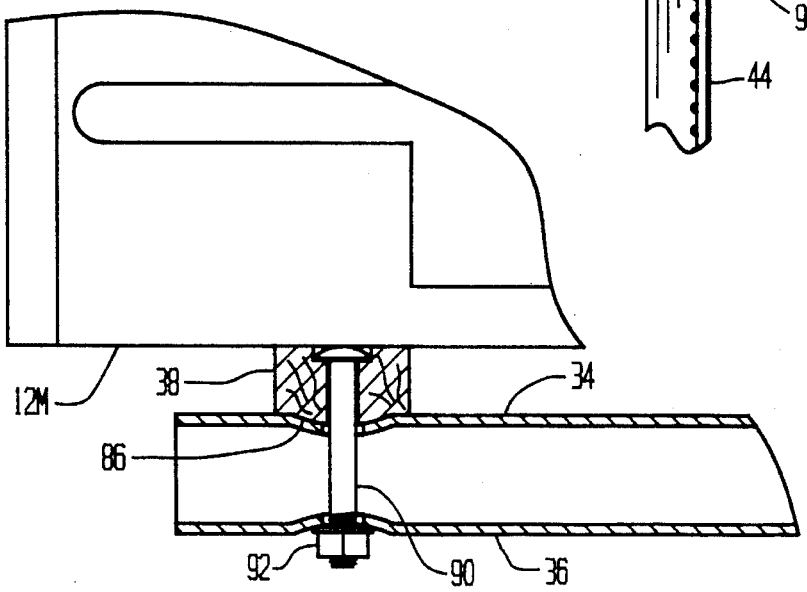
FIG. 7 is a partial view of the support arrangement shown in FIG. 12 broken away to show detail.
Figure 8:
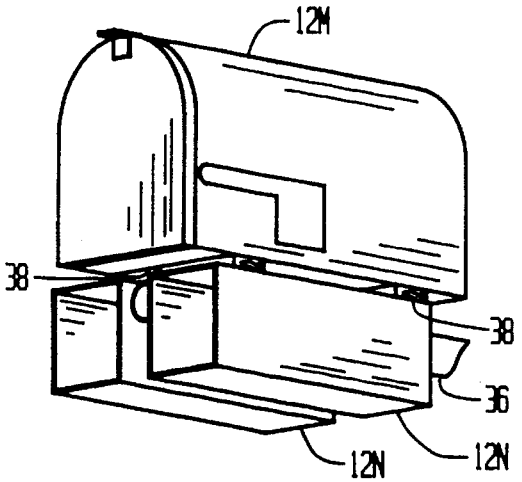
FIG. 8 is a partial view showing a pair of newspaper tubes attached to the horizontally extending portion.
Figure 9:
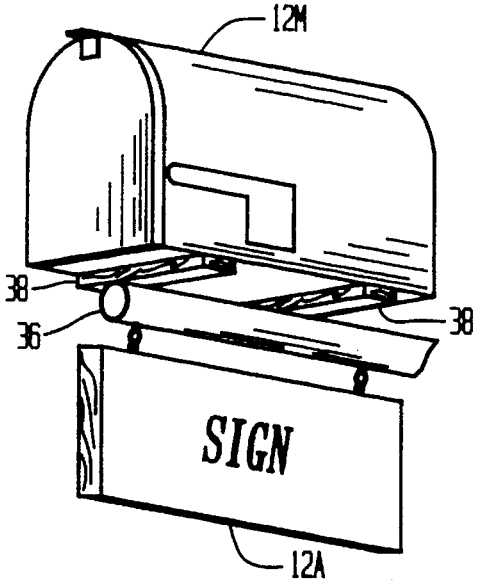
FIG. 9 is a view similar to FIG. 8 with a sign suspended from the horizontally extending portion.

Referring now to FIGS. 7, 8, and 9, stability of the transversely extending wood blocks 38 relative to horizontally extending portion 36 can be improved by creating indentations 86 when punching apertures 88 thereby providing a larger surface area against which the wood block is secured. A bolt 90 and a nut 92 are used to secure each wood block 38 by extending the bolt 90 through aligned apertures in the components and fastening with nut 92. The wood blocks 38 provide an excellent source for the attachment of the mailbox 12M and, when desired, newspaper tubes 12N can be attached to the underside thereof. Newspaper tubes 12N are preferably attached to the wood blocks by threaded fasteners (not shown) and the opening for each newspaper tube is set back from the end of the mailbox 12M, but positioned to extend beyond the distal end of horizontally extending portion 36. The support arrangement 10 can support a sign 12A either by rigidly connecting the sign to the fixed portion 24 or the sign can be fixed to or, as depicted, suspended from horizontally extending portion 36. There may be situations where the support arrangement 10 is used to simply support a sign such as a real estate sign or a sign for commercial advertising, however, it is contemplated that the support arrangement may support a mailbox, newspaper tubes, and an sign at the same time.

Figure 10:
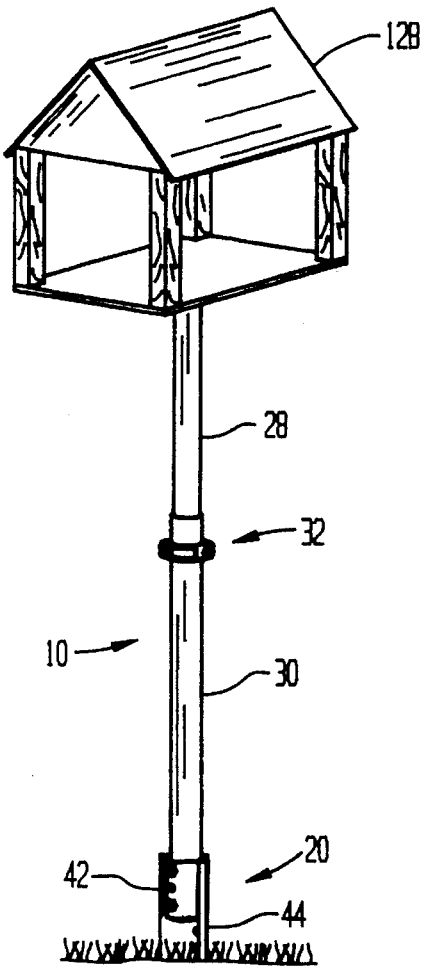
FIG. 10 is an embodiment of the instant invention showing a generally vertically extending support arrangement.

The embodiment of the support arrangement 10 depicted in FIG. 10 is a vertically extending support and, as shown, can support an object such as a bird feeder 12B or a bird house at the upper end thereof. It is also contemplated that a sign or other object may be supported along the length of the support arrangement as well as at the distal end thereof.

Figure 11:
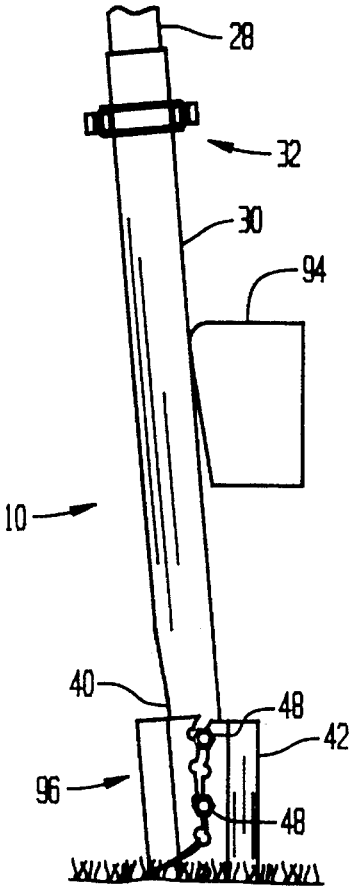
FIG. 11 is a partial view showing a bumper of a vehicle impacting the base pipe of the above-ground portion of the support arrangement.

An important feature of the instant invention is the frangible connector assembly 20, discussed with regards to FIG. 2, and the manner in which the assembly bends and breaks. It should be noted at the outset of this discussion that it has been found that the frangible connector assembly has been found to bend and break in a predictable manner. However, to break in a predictable manner the ground post needs to be disposed relative to the edge of the roadway such that the truncated V-shape opens toward the roadway. In the event of a vehicle impacting the support arrangement 10, best understood by referring to FIG. 11., i.e., when the bumper 94 of the vehicle strikes the bottom pipe 30, there is a concentration of forces in the area generally indicated as 96. When the support arrangement is impacted, the first occurrence is that the base pipe 30 will begin to bend in the area of its attachment to the exposed end 42 of the ground post 44. As the vehicle continues impacting the support arrangement, and the base pipe 30 continues to bend, there is a concentration of greater forces in the area generally indicated at 96 and the ground post 44 will begin to crack and ultimately will break generally along a line extending through the apertures in the ground post through which bolts 48 extend. Accordingly, as the impact occurs and continues, the object supported by the support arrangement and the support arrangement are accelerated in the direction of the impacting forces prior the breakage of the frangible connection. The progression of events is that the support arrangement will be accelerated in front of the vehicle and bend towards the ground prior to the frangible connector assembly 20 breaking, thereby not posing as a hazard to occupants of the vehicle. When properly installed, it is contemplated that after breaking off, all that will remain is a piece of the ground post extending above ground level which is less than four inches in height and the support arrangement and object will have broken off and thrown out of the path of the vehicle. In the event that the frangible connector assembly 20 should fail to break cleanly, i.e. wherein the bottom pipe 30 and exposed upper end 42 may still be connected but where the bottom pipe 30 has assumed a generally horizontal condition and the vehicle is passing over the connector assembly 20, the vehicle will then impact the object with the bottom side of the vehicle thereby causing the middle pipe 28 to be withdrawn from its telescoped relationship with the bottom pipe 30 by forcibly drawing the middle pipe 28 through the clamp assembly 32. In this latter situation the object and support arrangement are below the level of the windows in the vehicle and present a minimal hazard. It should be noted that when an extension 68 is used, the same area of concentration of forces on the exposed upper end of the ground post will be created with the same result.

Figures 12, 13, 14:
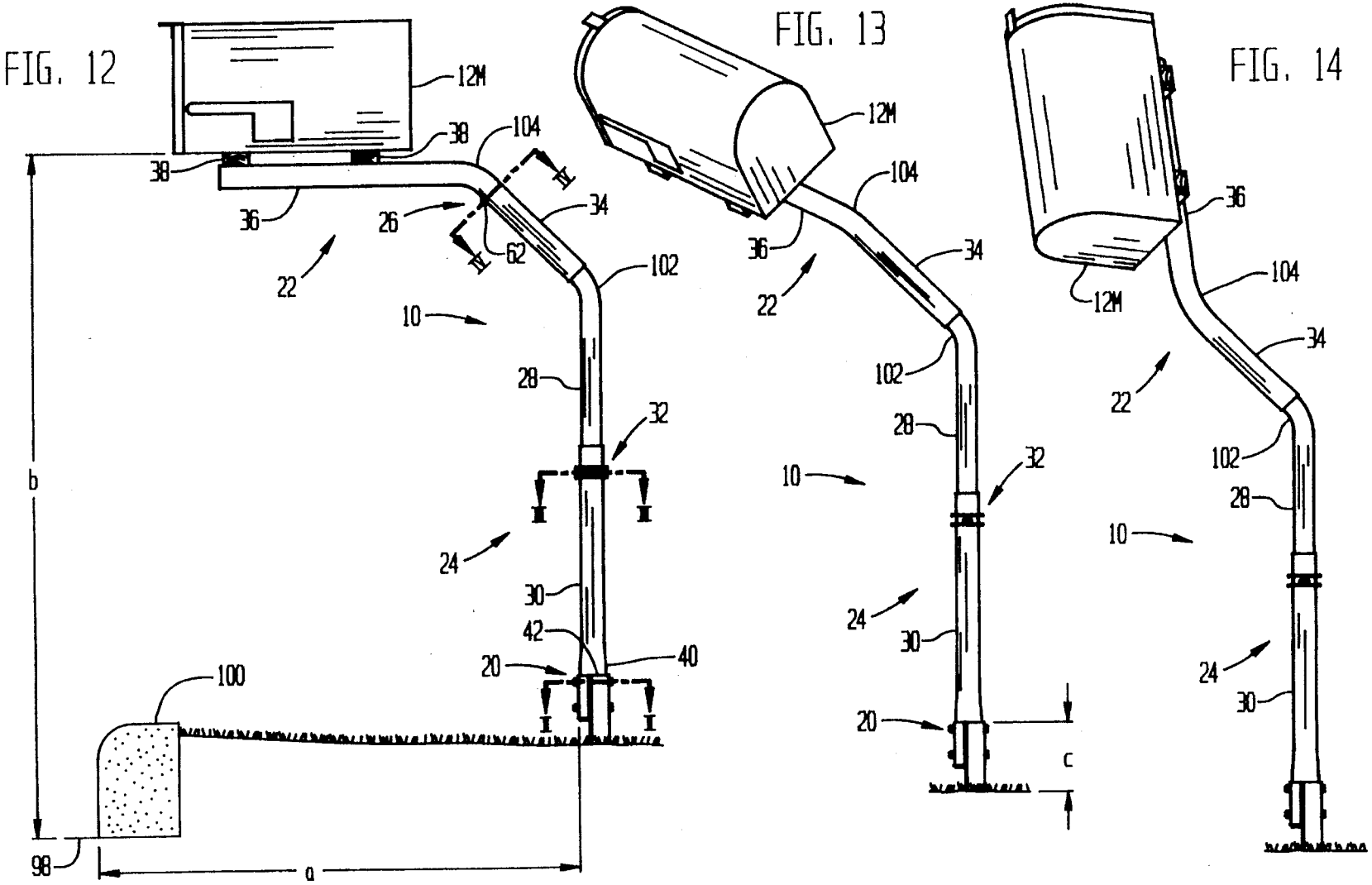
FIG. 12 is a side view of the support arrangement shown in FIG. 1 disposed relative to an edge of a roadway.
FIG. 13 is a view similar to FIG. 12 with the moveable portion of the support arrangement rotated about seventy degrees.
FIG. 14 is a view similar to FIG. 13 with the moveable portion of the support arrangement rotated about one hundred forty degrees.
Figure 17:
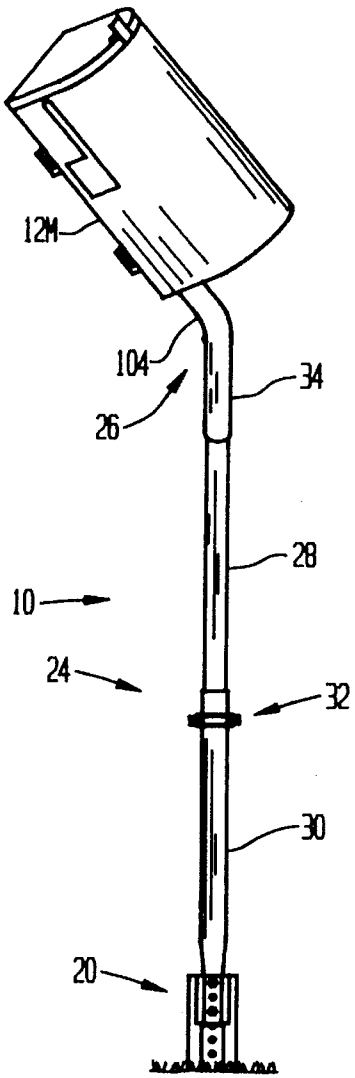
FIG. 17 is a front view of the support arrangement as depicted in FIG. 14.
Figure 16:
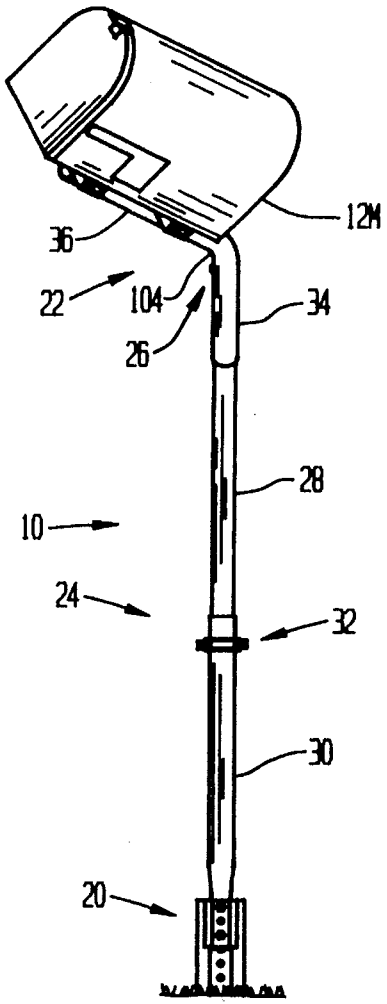
FIG. 16 is a front view of the support arrangement as depicted in FIG. 13.
Figure 15:
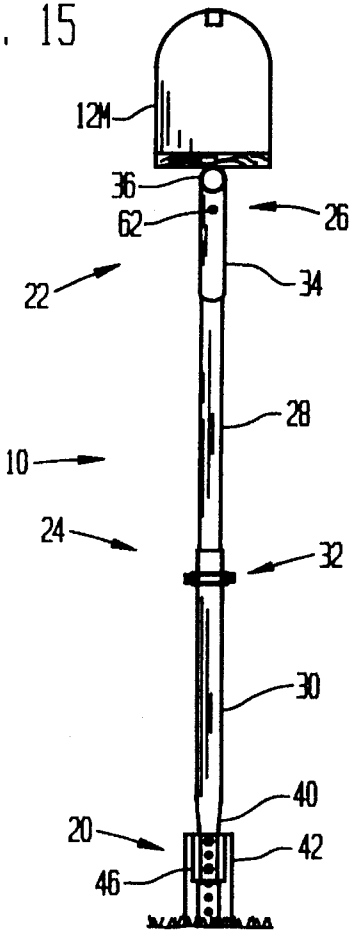
FIG. 15 is a front view of the support arrangement as depicted in FIG. 12.

When an object such as a mailbox is supported along a roadway 98 proximate the edge 100 (see FIG. 12) there is the possibility that only the cantilevered object will be impacted and not the support arrangement. The support arrangement of the instant invention has been designed with this possibility in mind and has features which are intended to minimize damage to the mailbox and any hazard to occupants of a vehicle that hits the mailbox. Accordingly, top pipe 34 preferably includes a bend of about 45 degrees and middle pipe 28 includes a bend of about 45 degrees such that horizontally extending portion 36 is disposed generally horizontally proximate the edge of the roadway. The rotatable connector assembly is positioned such that the notch 66 is at the lowest point of an arc scribed by the slot 64, the slot 64 being disposed in the angled portion of middle pipe 28, thereby creating an at-rest position for the horizontally extending portion 36 with an object 12 mounted thereon, as shown in FIGS. 12 and 15 wherein bolt 62 is resting in notch 66. When the horizontally extending portion and/or the object is impacted, e.g. by snow thrown by a plow, by a plow, or by a vehicle, etc., the moveable portion 22 will rotate in the manner depicted in the progressive FIGS. 12–14 and 15–17. FIGS. 13 and 16 show the horizontally extending portion rotated about 70 degrees and FIGS. 14 and 17 show the horizontally extending portion rotated about 140 degrees. In the preferred form, rotation is limited in each direction to about 140 degrees by bolt 62 engaging the end of slot 64, thereby preventing the object from rotating a full 360 degrees and the possibility that the object could impact the side of the vehicle as it passes by. An additional advantage of this arrangement is that the side profile of the object diminishes as rotation occurs thereby limiting the effect of impact by snow. Subsequent to passage of whatever force is impacting the mailbox, the weight of the horizontally extending portion and the mailbox will automatically return the moveable portion 22 to the at-rest position with the bolt 62 resting in the notch 66.

The device disclosed herein can be formed from any number of suitable materials and by any number of different processes. It has been found that galvanized steel tube is preferred for the base pipe, middle pipe, and top pipe and that the ground post is preferably of steel. The proper positioning of a mailbox relative to the edge of a roadway is for the in-ground portion 18 to be set back 46 inches, i.e., (distance a), the bottom of the mailbox should be spaced above the surface of the roadway about 45 inches, i.e., (distance b), and the exposed end 42 of the ground post 44 should extend no more than 4 inches above ground level, i.e., (distance c).

While this invention has been described with a certain degree if particularity, it should be understood that other forms of support arrangements are contemplated by the present invention and it is manifest that many changes may be made in the details of construction and in the arrangement of components without departing from the spirit and scope of the disclosure. It is understood that the invention is not limited to the embodiment set forth herein for purposes of exemplification, but is limited only by the scope of the attached claims, including the full range of equivalency to which each element is entitled.

I claim:

1. A support arrangement for an object supported above ground level including an above-ground portion and an in-ground portion connected by a frangible connector assembly, the frangible connector assembly forming a generally rigid connection coupling a generally vertically extending base pipe of the above-ground portion and a generally vertically oriented fixed ground post of the in-ground portion, said frangible connector assembly comprising:

an exposed upper end of said ground post having a truncated V-shaped cross-section;

a lower end of said generally vertically extending portion of said base pipe having a generally elliptical cross-section; and fastener means for securing said lower end of said base pipe to said exposed upper end of said ground post;

whereby said elliptical lower end of said base pipe is adapted to partially fit within said truncated V-shaped exposed upper end of said ground post such that said lower end of said base pipe is rigidly connected to and supported by said truncated V-shaped upper end of said ground post along more than two generally vertical lines of contact therebetween.

2. The support arrangement, as set forth in claim 1, further comprising:

a cap post having a truncated V-shaped cross-section adapted to be fastened to said exposed end of said ground post such that said truncated V-shaped cap post and said truncated V-shaped exposed end open toward one another and laterally encapsulate said elliptical lower end of said base pipe therebetween, whereby said cap post and said exposed upper end of said ground post contact and rigidly support said elliptical lower end of said vertically extending portion of said base pipe along more than four generally vertical lines of contact therewith.

3. The support arrangement, as set forth in claim 2, wherein:

said fastener means includes at least two bolts extending through aligned apertures in said cap post, said elliptical lower end of said base pipe, and said exposed end of said ground post.

4. The support arrangement, as set forth in claim 3, wherein:

said base pipe is tubular and an upper end thereof has a circular cross-section.

5. The support arrangement, as set forth in claim 4, wherein:

said above-ground portion includes a top pipe and means for attachment of said object to said top pipe.

6. The support arrangement, as set forth in claim 5, wherein:

said top pipe includes a generally horizontally extending portion and said means for attachment attaches said object to said horizontally extending portion; and said above-ground portion includes a rotatable connector means connecting said top pipe to said base pipe such that said horizontally extending portion, with said object attached thereto, can move relative to said base pipe.

7. The support arrangement, as set forth in claim 6, wherein:

said top pipe is tubular and has a circular cross-section of a predetermined size;

said tubular upper end of said base pipe has a circular cross-section of a predetermined size; and said above ground portion includes a tubular middle pipe having a circular cross-section of a predetermined size adapted to telescopically fit within said tubular upper end of said base pipe and a lower end of said tubular top pipe.

8. The support arrangement, as set forth in claim 7, further comprising:

a slot extending transversely of said tubular middle pipe;

an aperture in said top pipe; and pin means extending through said aperture and extending into said slot when said top pipe is telescoped over said middle pipe and said aperture is aligned with said slot to thereby limit rotation of said top pipe relative to said middle pipe and, accordingly, limit movement of the object attached to said horizontally extending portion.

9. The support arrangement, as set forth in claim 8, wherein:

said top pipe includes a bend therein and said middle pipe includes a bend therein, said bends complementing one another such that said horizontally extending portion can be disposed horizontally.

10. The support arrangement, as set forth in claim 9, wherein:

an upper portion of said middle pipe extends at an angle relative to said generally vertically extending base pipe;

said slot is generally centered on a bottom side of said upper portion of said middle pipe and extends at least two hundred seventy degrees therearound; and said slot includes a notch centrally disposed along a bottom edge of said slot for cooperating with said pin means to releasably maintain said horizontally extending portion in a generally horizontally disposed position.

11. The support arrangement, as set forth in claim 10, further comprising:

a clamp cooperating with said base pipe and said middle pipe to permit height adjustment of said horizontal portion above ground level.

12. The support arrangement, as set forth in claim 11, wherein:

said middle pipe includes a bend of generally forty-five degrees and said top pipe includes a bend of generally forty-five degrees; and said pin means includes a self-tapping fastener wherein an inner end of said fastener extends into and is guided by said slot such that when said object is displaced by an external force said object moves up and out of the path of said force.

13. The support arrangement, as set forth in claim 6, wherein:

said means for attachment includes generally vertically aligned punched apertures in said horizontally extending portion with dented areas around each aperture, pieces of wood extending transverse to said horizontally extending portion, and fasteners extending through said aligned apertures fastening said pieces of wood relative to said horizontally extending portion, whereby said dented areas create larger surface areas against which said wood pieces are secured to thereby provide greater stability for said object when said object is attached to said wood pieces.

14. The support arrangement, as set forth in claim 13, wherein:

said object is a mailbox attached to a top side of said wood pieces and said means for attachment includes threaded fasteners fastening said mailbox to said wood pieces.

15. The support arrangement, as set forth in claim 14, wherein:

said object includes news paper tubes secured to a bottom side of said wood pieces by threaded fasteners; and said fasteners for securing said wood pieces to said horizontally extending portion include eye-bolts to which a depending sign can be attached.

16. The support arrangement, as set forth in claim 3, wherein:

said truncated V-shaped exposed end of said ground post includes laterally extending flanges on either side thereof;

said truncated V-shaped cap post includes laterally extending flanges on either said thereof; and said exposed end, said cap post, and said elliptical end of said base pipe are secured together by said bolts and cooperate to form a generally rigid frangible connection between said above-ground portion and said in-ground portion wherein there are six generally vertical lines of contact between said cap post, said ground post, and said elliptical lower end of said base pipe, and respective flanges on either side of said truncated V-shaped exposed end and said truncated V-shaped cap post are abutted to thereby provide greater stability for said above-ground portion.

17. The support arrangement, as set forth in claim 16, wherein:

said truncated V-shaped cross-section of said ground post is of a first predetermined size;

said truncated V-shaped cross-section of said cap post is of a second predetermined size smaller than said first predetermined size; and said elliptical lower end of said base pipe is sized such that, when respective flanges of said cap post and said exposed end are drawn together by said bolts, said elliptical lower end is laterally encapsulated by said cap post and said exposed end of said base post and supported along six generally vertical lines of contact therebetween.

18. The support arrangement, as set forth in claim 17, wherein:

said elliptical lower end of said base post terminates at approximately a lower end of said cap post, said cap post, said elliptical lower end, and said bolts cooperating to determine an area of stress concentration on said ground post when said above ground portion is impacted by an external force, such as a vehicle, thereby ensuring bending and breaking of said ground post in said area of stress concentration.

19. The support arrangement, as set forth in claim 18, wherein:

said ground post includes an extension having a truncated V-shaped cross-section with laterally extending flanges of a same predetermined cross-sectional size as said ground post;

said extension being connected to said ground post by nesting said truncated V-shaped cross-section of said extension within said truncated V-shaped cross-section of said ground post;

spacer means disposed between generally parallel bight portions of said truncated V-shaped ground post and said truncated V-shaped extension; and fasteners in the form of bolts extending through aligned apertures in said ground post, said extension, and said spacer means for rigidly securing said extension to said base post, whereby another frangible connection on said ground post is defined.

20. A support arrangement, as set forth in claim 18, wherein:

said base pipe is tubular and an upper end thereof has a circular cross-section of a predetermined size;

said above-ground portion includes a tubular top pipe having a circular cross section of a predetermined size and a tubular middle pipe having a circular cross-section of a predetermined size adapted to telescopically fit within said tubular upper end of said base pipe and a lower end of said tubular top pipe;

said top pipe includes a bend therein and a horizontally extending portion and said middle pipe includes a bend therein such that an upper portion of said middle pipe extends at an angle relative to said generally vertically extending base pipe and said bends complement one another such that said horizontally extending portion can be disposed horizontally;

rotatable connector means connecting said top pipe to said base pipe to thereby permit movement of said top pipe relative to said base pipe;

a slot generally centered on a bottom side of said upper portion of said middle pipe extending transversely at least two hundred seventy degrees therearound;

an aperture in said top pipe;

pin means extending through said aperture and extending into said slot when said top pipe is telescoped over said middle pipe and said aperture is aligned with said slot to thereby limit rotation of said top pipe relative to said middle pipe and, accordingly, limit movement of an object attached to said horizontally extending portion, said pin means includes a self-tapping fastener wherein an inner end of said fastener extends into and is guided by said slot such that when said object is displaced by an external force, said object moves up and out of the path of said force;

a notch centrally disposed along a bottom edge of said slot for cooperating with said pin means to releasably maintain said horizontally extending portion in a generally horizontally disposed position;

a clamp cooperating with said base pipe and said middle pipe to permit height adjustment of said horizontally extending portion above ground level, said clamp includes a pair of bolts cooperating with apertures in said upper end of said base pipe to fix said middle pipe relative to said base pipe; and said top pipe includes attachment means attaching said object to said horizontally extending portion.

21. A support arrangement, as set forth in claim 20, wherein:

said means for attachment includes generally vertically aligned punched apertures in said horizontally extending portion with dented areas around each aperture, pieces of wood extending transverse to said horizontally extending portion, and fasteners extending through said aligned apertures fastening said pieces of wood relative to said horizontally extending portion, whereby said dented areas create larger surface areas against which said wood pieces are secured to thereby provide greater stability for said object when said object is attached to said wood pieces;

said object includes a mailbox attached to top sides of said wood pieces and news paper tubes secured to bottom sides of said wood pieces and said attachment means includes threaded fasteners securing said mailbox and said newspaper tubes to said wood pieces;

said fasteners for securing said wood pieces to said horizontally extending portion include eye-bolts to which a depending sign can be attached.

22. A support arrangement for an object movably supported above ground level including a rotatable connector assembly, the support arrangement including an above-ground portion connected to an in-ground portion by a frangible connector assembly and the above-ground portion including a moveable portion connected to a fixed portion by said rotatable connector assembly, said rotatable connector assembly comprising:

an upper end of said fixed portion being tubular and having a circular cross-section;

a slot in said upper end of said fixed portion extending transversely of said upper end more than one hundred eighty degrees therearound;

a lower end of said moveable portion being tubular and having a circular cross-section adapted to be telescoped relative to said upper end of said fixed portion;

an aperture in said moveable portion; and pin means for extending through and being fixed relative to said aperture when said upper end of said fixed portion and said lower end of said moveable portion are telescoped and said aperture is aligned with said slot, wherein said pin means extends into said slot to thereby prevent removal of said moveable portion from said fixed portion and cooperate with said slot to guide rotatable motion of said moveable portion relative to said fixed portion.

23. The support arrangement, as set forth in claim 22, wherein:

said slot extends transversely of said upper end of said fixed portion at least two hundred seventy degrees; and said lower end of said rotatable portion telescopes over and reinforces said slotted upper end of said fixed portion when secured relative thereto by said pin means.

24. The support arrangement, as set forth in claim 23, further comprising:

a notch centrally disposed in a lower edge of said slot for cooperating with said pin means to locate said moveable portion in a predetermined position.

25. The support arrangement, as set forth in claim 24, wherein:

said fixed portion includes a base pipe connected at a lower end to said frangible connector assembly and a middle pipe having a lower end telescopically received by an upper end of said base pipe.

26. The support arrangement, as set forth in claim 25, further comprising:

clamp means for adjustably fixing said lower end of said middle pipe relative to said upper end of said base pipe; and said moveable portion includes a top pipe having a horizontally extending portion and said object is mounted to said horizontally extending portion;

whereby said horizontally extending portion of said top pipe can be spaced a predetermined distance above ground level and fixed at said distance by said clamp means fixing said telescoped lower end of said middle pipe relative to said upper end of said base pipe.

27. The support arrangement, as set forth in claim 26, wherein:

said middle pipe includes a bend of generally 45° along the length thereof and said top pipe includes a bend of generally 45° along the length thereof such that an upper portion of said middle pipe extends at an angle relative to said generally vertically extending base pipe;

said slot is generally centered on a bottom side of said upper portion of said middle pipe and extends at least two hundred seventy degrees therearound;

said slot includes a notch centrally disposed along a bottom edge of said slot for cooperating with said pin means to releasably maintain said horizontally extending portion in a generally horizontally disposed position; and said pin means includes a self-tapping fastener wherein an inner end of said fastener extends into and is guided by said slot such that when said object is displaced by an external force, said object moves up and out of the path of said force.

28. The support arrangement, as set forth in claim 27, wherein:

said in-ground portion includes a ground post having a truncated V-shaped cross-section, said ground post including a portion for being driven into the ground and an exposed upper end;

a lower end of said base pipe includes a portion having a generally elliptical cross-section;

said frangible connector includes a cap post having a truncated V-shaped cross-section adapted to be fastened to said exposed end of said ground post with said elliptical end of said base pipe laterally encapsulated therebetween and fastener means, including at least two bolts extending through aligned apertures in said cap post, said elliptical end, and said ground post, for generally rigidly securing the cap post, the elliptical end, and the ground post together, wherein said ground post and said cap post contact and support said elliptical end of said base pipe along six generally vertical lines of contact.

29. The support arrangement, as set forth in claim 28, wherein:

said object support by said horizontally extending portion includes a mailbox and said ground post is adapted to be driven into the ground a predetermined distance from an edge of a roadway with said truncated V-shaped cross-section opening toward said roadway such that said mailbox is positioned relative to said outer edge;

whereby a vehicle, leaving said roadway and impacting said above ground portion of said support arrangement, will cause bending and breaking of said frangible connector such that said support arrangement will be driven downward toward ground level.

30. The support arrangement, as set forth in claim 29, wherein:

said ground post includes an extension having a truncated V-shaped cross-section with laterally extending flanges, said cross-section of said extension being of a same predetermined cross-sectional size as said ground post;

said extension is connected to said ground post by nesting said truncated V-shaped cross-sections within one another with spacer means disposed between generally parallel bight portions of said truncated V-shaped ground post and said truncated V-shaped extension; and fasteners in the form of bolts extending through aligned apertures in said ground post, said extension, and said spacer means for rigidly securing said extension to said ground post such that another frangible connection on said ground post is defined.

* * * * *